United States Patent [19]

Kopatz et al.

[11] Patent Number: 4,913,731

[45] Date of Patent: Apr. 3, 1990

[54] PROCESS OF MAKING PREALLOYED TUNGSTEN ALLOY POWDERS

[75] Inventors: Nelson E. Kopatz, Sayre, Pa.; Walter A. Johnson, Houghton, Mich.; Joseph E. Ritsko, Towanda, Pa.

[73] Assignee: GTE Products Corporation, Stamford, Conn.

[21] Appl. No.: 252,411

[22] Filed: Oct. 3, 1988

[51] Int. Cl.[4] ..... B22F 9/24

[52] U.S. Cl. ..... 75/346; 75/351; 75/365

[58] Field of Search ..... 75/0.5 BB, 0.5 C

[56] References Cited

U.S. PATENT DOCUMENTS

| | | | |
|---|---|---|---|
| 4,731,110 | 3/1988 | Kopatz et al. | 75/0.5 C |
| 4,731,111 | 3/1988 | Kopatz et al. | 75/0.5 BB |
| 4,743,297 | 5/1988 | Kopatz et al. | 75/0.5 BB |
| 4,756,746 | 7/1988 | Kemp, Jr. et al. | 75/0.5 BB |
| 4,793,969 | 12/1988 | Johnson et al. | 75/0.5 BB |

*Primary Examiner*—Upendra Roy
*Attorney, Agent, or Firm*—Donald R. Castle

[57] ABSTRACT

A process for forming particulate tungsten alloys from the individual metal sources comprises forming an aqueous solution containing the individual metals for producing tungsten heavy alloys, producing a solid particulate material from the solution and injecting the particle material into a high temperature zone and retaining such material in the high temperature zone for a time sufficient to at least partially melt the metals that are alloying with tungsten while maintaining the temperature of those metals below the boiling point of the lowest boiling metal in the second component. The prealloyed composite powder contains tungsten grains below about 5 micrometers as a discontinuous phase and has a continuous phase of the tungsten and a second component selected from nickel, iron, copper and mixtures thereof.

19 Claims, No Drawings

PROCESS OF MAKING PREALLOYED TUNGSTEN ALLOY POWDERS

FIELD OF THE INVENTION

This invention relates to the preparation of composite tungsten heavy alloy metal powders containing a discontinuous tungsten phase. More particularly it relates to the production of such powders via a hydrometallurgical technique followed by plasma processing.

BACKGROUND OF THE INVENTION

Tungsten heavy alloys are that class of two phase multicomponent tungsten alloys containing tungsten and at least one other metal component such as, nickel, iron or copper. These alloys are defined in the *Metals Handbook.* Ninth Edition, Vol. 7. ASM, Metal Park, Ohio 44073. One phase in such alloys is essentially tungsten and the other phase is a solid-solution of tungsten and the other metal component.

Tungsten heavy alloy structures heretofore have been produced by liquid phase sintering of pressed powders. The liquid phase sintering process creates a very homogenous microstructure, however, the size of the tungsten grains grow from about 5 micrometers to over about 30 micrometers during the sintering process. If consolidation processes other than liquid phase sintering are used to achieve final densification, the microstructures have generally been insufficiently homogeneous to yield satisfactory mechanical properties unless certain additional working steps are taken to improve the mechanical properties of the consolidated billet.

It is believed that a relatively simple process which enables tungsten heavy alloy powders consisting essentially of tungsten and a second metal selected from the group consisting of iron, nickel, copper and mixtures thereof wherein the powder particles consisting essentially of a discontinuous tungsten phase relatively uniformly distributed in a matrix of tungsten and the second metal to be produced from sources of the individual metals without excessive tungsten grain growth would be an advancement in the art.

SUMMARY OF THE INVENTION

In accordance with one aspect of this invention there is provided a process comprising:

(a) forming an aqueous solution wherein the tungsten content constitutes from about 70% to about 98% by weight of the total metal content in the solution and the balance is a second metal component wherein the second metal is selected from the group consisting of nickel, iron, copper and mixtures thereof, (b) forming a reducible solid material from said aqueous solution, (c) reducing said solid material to form metallic powder particles, (d) entraining at least a portion of these powder particles in a carrier gas, (f) feeding entrained particles and gas into a high temperature zone and retaining the particles in the zone for a sufficient time to achieve a temperature in the particles of between the melting point of the second metal component and the boiling point of the lowest boiling metal in the second metal component to form partially molten droplets and (g) cooling such droplets to form a powdered tungsten heavy alloy, wherein the alloy has a continuous phase of an alloy of tungsten and the second metal component and a discontinuous tungsten phase and wherein in the alloy, tungsten constitutes from about 70% to about 98% by weight of the alloy and the balance is the second metal component.

In accordance with another aspect of this invention there is provided a metal powder composition consisting essentially of metal powder particles having a tungsten content of from about 70% to about 98% by weight, balance a second component selected from the group consisting of nickel, iron, copper and mixtures thereof, wherein the particles have a continuous matrix phase of an alloy of tungsten and the second component and a discontinuous tungsten phase of tungsten grains having a size less than about 5 micrometers.

DETAILS OF THE PREFERRED EMBODIMENTS

For a better understanding of the present invention, together with other and further objects, advantages, and capabilities thereof, reference is made to the following disclosure and appended claims in connection with the foregoing description of some of the aspects of the invention.

In the practice of this invention, tungsten heavy alloys can be formed containing from about 70% to about 98% by weight of tungsten. Preferred tungsten heavy alloys are those containing from about 88% to about 98% by weight of tungsten while especially preferred alloys are those containing from about 93% to about 98% by weight of tungsten.

In producing tungsten heavy alloys of this invention, from about 70% to about 98% by weight of the alloy is tungsten and the balance is a second component selected from the group consisting of nickel, iron, copper and mixtures thereof. When nickel and iron are used as the second component, a weight ratio of from about 1:1 to about 100:1 is satisfactory, however, a weight ratio of from about 2:1 to about 10:1 is preferred, while a weight ratio of from about 6:4 to about 8:2 is especially preferred. When copper is added as a portion of the second component it can be added in amount to replace up to about 50% of the iron thus, the weight ratio of iron to copper in such alloys is from about 1:1 to about 100:1.

U.S. Pat. Nos. 3,663,667; 3,909,241; 3,974,245; 4,025,334; 4,502,885 and 4,508,788; 4,592,781; 4,705,560; 4,723,993; 4,731,110; 4,71,111; and 4,756,746 all relate to the formation of free flowing powders via a high temperature plasma reactor to cause at least partial melting of the particles. Resulting powders are spherical and free flowing.

While the before-mentioned processes produce the products mentioned therein, it has been found that better overall yields can be obtained when certain tungsten alloys such as tungsten heavy alloys are desired by performing the process of this invention. It has been found that when tungsten is alloyed with a second metal component to form the tungsten heavy alloys and the alloy forming materials are fed to the plasma zone it is necessary to retain the materials in the plasma zone for a sufficient time to enable the second metal component to reach its melting point, however, care must be taken to not allow the temperature of the materials to rise above about the boiling point of the boiling point of the lowest boiling metal in the second component that is being alloyed with tungsten. By the practice of this invention excessive losses of the second component are avoided.

While it is preferred to use sources of the metals that are water soluble, thus, can be combined in the proper ratio to achieve a single solution in one step, there are different approaches that can be used. For example, one can use metal powder, that is, nickel, iron and copper powders, as starting materials in the practice of this invention to form a first aqueous solution by dissolving. The metal values can be dissolved in any water soluble acid. The acids can include the mineral acids as well as the organic acids such as acetic, formic and the like. Hydrochloric is especially preferred because of cost and availability. Thereafter, the resulting acid solution is combined with the appropriate amount of an aqueous solution of tungsten to yield the aqueous solution that is further processed in accordance with this invention. Metal salts can be used as the source of the second component and are preferred from a processing standpoint because such materials dissolve more readily than some other forms of metals. However, the economic factors surrounding the relative prices of the various sources of raw materials will often dictate the particular source that is used.

If more than one metal is to be used in the second component, an aqueous solution of each metal can be initially prepared and then combined with the other sources which form the raw materials of the alloys of this invention.

Ammonium metatungstate is the preferred source of tungsten although any water-soluble tungsten salt can be used. Solubility of tungsten salts depend upon the pH of the dissolving media, therefore, an acid may be used to adjust the pH to the level for the solubility to occur. Tungsten metal powder can be used as the source of tungsten, however, its use is not the preferred source because of the difficulty in forming aqueous solutions that are compatible with the aqueous sources of the alloying metals. For example, while tungsten is soluble in a base such as sodium hydroxide, such a solution would create problems with sodium contamination of the other metals. Ammonium hydroxide can be used, however, the conversion of tungsten metal or tungsten oxide to the ammonium salt is often more costly than using the ammonium salts directly. In any event the selection of the tungsten source will be governed to a large extent by the economics of the marketplace. Tungsten content and the content of the second component in the subsequently formed solids of the salts, oxides or hydroxides can be calculated based upon the raw material input or the solid can be sampled and analyzed for the metal ratio.

After the solution is formed it can be subjected to sufficient heat to evaporate water. The metal compounds, for example, the oxides, hydroxides, sulfates, nitrates, chlorides, and the like, will precipitate from the solution under certain pH conditions. The solid materials can be separated from the resulting aqueous phase or the evaporation can be continued. Continued evaporation results in forming particles of a residue consisting of the metallic compounds. In some instances, when the evaporation is done in air, the metal compounds may be the hydroxides, oxides or mixtures of the mineral acid salts of the metals and the metal hydroxides or oxides. The residue may be agglomerated and contain oversized particles. The average particle size of the materials can be reduced in size, generally below about 20 micrometers by milling, grinding or by other conventional methods of particle size reduction.

After the particles are reduced to the desired size they are heated in a reducing atmosphere at a temperature above the reducing temperature of the salts but below the melting point of the metals in the particles. The temperature is sufficient to evolve any water of hydration and the anion. If hydrochloric acid is used and there is water of hydration present the resulting wet hydrochloric acid evolution is very corrosive thus appropriate materials of construction must be used. The temperatures employed are below the melting point of any of the metals therein but sufficiently high to reduce and leave only the cation portion of the original molecule. In most instances a temperature of at least about 500° C. is required to reduce the compounds. Temperatures below about 500° C. can cause insufficient reduction while temperatures above the melting point of the metal result in large fused agglomerates. If more than one metal is present the metals in the resulting multimetal particles can either be combined as intermetallics or as solid solutions of the various metal components. In any event there is a relatively homogeneous distribution throughout each particle of each of the metals. The particles are generally irregular in shape. If agglomeration has occurred during the reduction step, particle size reduction by conventional milling, grinding and the like can be done to achieve a desired average particle size for example less than about 20 micrometers with at least 50% being below about 20 micrometers.

The resulting particles are entrained in a carrier gas and then fed into a high temperature reactor. While the temperature in the reactor can be quite high, for example about 17,000° C. is not uncommon in a plasma reactor, the outside of the plasma is not nearly as high and can be as low as about 4000° C. It is essential, therefore, that the residence time in the reactor is very short and preferably the particles are injected into the outer edge of the plasma to avoid overheating of the particles. Overheating of the particles can result in loss of some of the second metal component because of excessive vaporization. Thus, the particles are retained in the plasma for a time sufficient to raise at least 50% of the agglomerate mass to a temperature which is above the melting point of the second metal component of the metal powder but below the boiling point of the lowest boiling metal in the second component.

The stream of dispersed entrained partially molten metal droplets is produced by plasma-jet torch or gun apparatus of conventional nature. In general, the agglomerates are connected to a source of propellant gas. A means is provided to mix the gas with the powder and propel the gas with entrained powder through a conduit communicating with a nozzle passage of the plasma spray apparatus. In the arc type apparatus, the entrained powder may be fed into a vortex chamber which communicates with and is coaxial with the nozzle passage which is bored centrally through the nozzle, however, as previously mentioned the retention time is short and it is preferred to feed the material into the coolest part of the plasma which is normally the outer edge. In an arc type plasma apparatus, an electric arc is maintained between an interior wall of the nozzle passage and an electrode present in the passage. The electrode has a diameter smaller than the nozzle passage with which it is coaxial to so that the gas is discharged from the nozzle in the form of a plasma jet. The current source is normally a DC source adapted to deliver very large currents at relatively low voltages. By adjusting the magnitude of the arc power and the rate of gas flow, torch temperatures can range from 5500 degrees centigrade up to about 15,000 degrees centigrade. The apparatus generally must be adjusted in accordance with the melting point of the powders being sprayed and the gas employed. In general, the electrode may be retracted within the nozzle when lower boiling second metal components are utilized with an inert gas such as nitrogen while the electrode may be more fully extended within the nozzle when higher boiling second metal components are utilized with an inert gas such as argon.

In the induction type plasma spray apparatus, metal powder entrained in an inert gas is passed at a high velocity through a strong magnetic field so as to cause a voltage to be generated in the gas stream. The current source is adapted to deliver very high currents, on the order of 10,000 amperes, although the voltage may be relatively low such as 10 volts. Such currents are required to generate a very strong direct magnetic field and create a plasma. Such plasma devices may include additional means for aiding in the initiation of a plasma generation, a cooling means for the torch in the form of annular chamber around the nozzle.

In the plasma process, a gas which is ionized in the torch regains its heat of ionization on exiting the nozzle to create a highly intense flame. In general, the flow of gas through the plasma spray apparatus is effected at speeds at least approaching the speed of sound. The typical torch comprises a conduit means having a convergent portion which converges in a downstream direction to a throat. The convergent portion communicates with an adjacent outlet opening so that the discharge of plasma is effected out the outlet opening.

Other types of torches may be used such as an oxyacetylene type having high pressure fuel gas flowing through the nozzle. The powder may be introduced into the gas by an aspirating effect. The fuel is ignited at the nozzle outlet to provide a high temperature flame.

Preferably the particles fed to the plasma are relatively uniform in size. A relatively narrow size distribution is desirable because, under set flame conditions, the largest particles may not have enough of the second component melted whereas the smallest particles may be heated to a temperature where losses through vaporization are excessive. Incomplete melting is a detriment to the product uniformity, whereas vaporization decreases process efficiency. Typically, the size ranges for plasma feed powders of this invention are such that 80 percent of the particles fall within about a 20 micrometer diameter range.

In the preferred process of the present invention, a high velocity stream of partially molten metal droplets is formed. Individual particles will not be completely melted because the material cannot reach the melting point of tungsten which is higher than the boiling points of the metals in the second component. At least about 50% of the second metal component is melted to enable the alloys to be formed. Typically, the velocity of the droplets is greater than about 100 meters per second, more typically greater than 250 meters per second. Velocities on the order of 900 meters per second or greater may be achieved under certain conditions which favor these speeds which may include spraying in a vacuum.

The stream of entrained partially molten metal droplets which issues from the nozzle tends to expand outwardly so that the density of the droplets in the stream decreases as the distance from the nozzle increases. Prior to impacting a surface, the stream typically passes through a gaseous atmosphere which solidifies and decreases the velocity of the droplets. As the atmosphere approaches a vacuum, the cooling and velocity loss is diminished. It is desirable that the nozzle be positioned sufficiently distant from any surface so that the partially molten droplets remain in a droplet form during cooling and solidification. If the nozzle is too close, the droplets may solidify after impact.

The stream of partially molten particles may be directed into a cooling fluid. The cooling fluid is typically disposed in a chamber which has an inlet to replenish the cooling fluid which is volatilized and heated by the molten particles and plasma gases. The fluid may be provided in liquid form and volatilized to the gaseous state during the rapid solidification process. The outlet is preferably in the form of a pressure relief valve. The vented gas may be pumped to a collection tank and reliquefied for reuse.

The choice of the particle cooling fluid depends on the desired results. If large cooling capacity is needed, it may be desirable to provide a cooling fluid having a high thermal capacity. An inert cooling fluid which is non-flammable and nonreactive may be desirable if contamination of the product is a problem. In other cases, a reactive atmosphere may be desirable to modify the powder. Argon and nitrogen are preferable nonreactive cooling fluids. Hydrogen may be preferable in certain cases to reduce oxides and protect the powder from unwanted reactions.

Since the melting plasmas are formed from many of the same gases, the melting system and cooling fluid may be selected to be compatible.

The cooling rate depends on the thermal conductivity of the cooling fluid and the molten particles to be cooled, the size of the stream to be cooled, the size of individual droplets, particle velocity and the temperature difference between the droplet and the cooling fluid. The cooling rate of the droplets is controlled by adjusting the above mentioned variables. The rate of cooling can be altered by adjusting the distance of the plasma from the liquid bath surface. The closer the nozzle is to the surface of the bath, the more rapidly the droplets are cooled.

Powder collection is conveniently accomplished by removing the collected powder from the bottom of the collection chamber. The cooling fluid may be evaporated or retained if desired to provide protection against oxidation or unwanted reactions.

The particle size of the powders will be largely dependent upon the size of the feed into the high temperature reactor. Some densification occurs and the surface area is reduced thus the apparent particle size is reduced. The preferred form of particle size measurement is by micromergraph, sedigraph or Microtrac. A majority of the particles will be below about 100 micrometers or finer with the average particle size ranging from about 10 to about 80 micrometers. The desired size will depend upon the use of the alloy.

To further illustrate this invention, the following non-limiting examples are presented. All parts, proportions and percentages are by weight unless otherwise indicated.

EXAMPLE 1

About 600 parts of ferric chloride, about 1300 parts of nickel chloride and about 1100 parts of ammonium metatungstate are dissolved in about 11,000 parts of water at about 80° C. using a glass lined agitated reactor to form an aqueous solution.

The solution is then evaporated to dryness. The solids are then heated to about 500° C. in air for about 3 hours to remove ammonium chlorides. This mixture is then hammermilled and screened to produce a powder having a size less than the openings in a 200 mesh screen.. These milled particles are heated in a reducing atmosphere of $H_2$ at a temperature of about 750° C. for about 3 hours. Finely divided particles ar formed which are an intimate mixture of tungsten, nickel and iron.

The W Ni Fe particles are entrained in an argon carrier gas and are fed at a rate of about 20 pounds per hour. The carrier gas is fed at a rate of about 7 cubic feet per hour. The particles are passed through a high temperature plasma torch power is about 25 KW at about 50 volts and 500 amperes. The molten droplets exit into a chamber containing inert gas. The resulting particles have a continuous matrix phase of a tungsten-nickel-iron alloy and a discontinous tungsten phase consisting of tungsten grains having a size less than about 5 micrometers.

EXAMPLE 2

About 200 parts of iron powder and about 600 parts of nickel powder are dissolved in about 300 parts of 10 N HCl using a glass lined agitated reactor to form a first aqueous solution.

A second aqueous solution is formed by dissolving about 11,000 parts of ammonium metatungstate in about 7,000 parts of water. A third aqueous solution is formed by mixing the above solutions. The third solution is then evaporated to dryness. The solids are then heated to about 500° C. in air for about 3 hours to remove ammonium chloride. This mixture is then hammermilled and screened to produce a powder having a size less than the openings in a 200 mesh screen. These milled particles are heated in a reducing atmosphere of $H_2$ at a temperature of about 750° C. for about 3 hours. Finely divided particles are formed which are an intimate mixture of tungsten, nickel and iron.

The W Ni Fe particles are entrained in an argon carrier gas and are fed at a rate of about 20 pounds per hour. The carrier gas is fed at a rate of about 7 cubic feet per hour. The particles are passed through a high temperature plasma flame consisting of about 80 SCFH Ar and 40 SCFH He. The torch power is about 25 KW at about 50 volts and 500 amperes. The molten droplets exit into a chamber containing inert gas. The resulting particles have a continuous matrix phase of a tungsten-nickel-iron alloy and a discontinous tungsten phase consisting of tungsten grains having a size less than about 5 micrometers.

While there has been shown and described what are considered the preferred embodiments of the invention, it will be obvious to those skilled in the art that various changes and modifications may be made therein without departing from the scope of the invention as defined by the appended claims.

What is claimed:

1. A process comprising:

(a) forming an aqueous solution of ammonium metatungstate wherein the tungsten content constitutes from about 70% to about 98% by weight of the total metal content in the solution and the balance is a second metal component wherein the second metal is selected from the group consisting of water soluble salts, nickel, iron, copper and mixtures thereof, (b) forming a reducible solid material from said aqueous solution, (c) reducing said solid material to form metallic powder particles, (d) entraining at least a portion of said powder particles in a carrier gas to form a mixture, (f) feeding the resulting entrained particles and gas mixture into a high temperature zone and retaining the particles in the zone for a sufficient time to achieve a temperature in the particles of between the melting point of the second metal component and the boiling point of the lowest boiling metal in the second metal component to form partially molten droplets and (g) cooling such droplets to form a powdered tungsten heavy alloy having a continuous phase of an alloy of tungsten and the second metal component and a discontinuous tungsten phase containing individual tungsten grains and wherein in the alloy, tungsten constitutes from about 70% to about 98% by weight of the alloy and the balance is the second metal component.

2. A process according to claim 1 wherein said solution is formed by dissolving at least one metal value in a water soluble acid.

3. A process according to claim 1 wherein said solution contains a mineral acid selected from the group consisting of hydrochloric, sulfuric and nitric acids.

4. A process according to claim 3 wherein said mineral acid is hydrochloric acid.

5. A process according to claim 1 wherein said reducible solid material is formed by adjusting the pH of the solution to form a solid which is separated from the resulting aqueous phase.

6. A process according to claim 1 wherein said carrier gas is an inert gas.

7. A process according to claim 1 wherein said material produced by step (b) is subjected to a particle size reduction step prior to the reduction step (c).

8. A process according to claim 1 wherein the powder particles from step (c) are subjected to a particle size reduction step prior to the entraining step (d).

9. A process according to claim 1 wherein said high temperature zone is created by a plasma torch.

10. A process according to claim 1 wherein essentially all of said metal particles in said second component are melted.

11. A process according to claim 1 wherein at least 50% of said particles have an average particle size less than about 20 micrometers.

12. A process according to claim 1 wherein said second component is nickel.

13. A process according to claim 1 wherein said second component is nickel and iron.

14. A process according to claim 1 wherein said second component is nickel, iron and copper.

15. A process according to claim 1 wherein said reducible solid material is formed by evaporation of the water from the solution.

16. A process according to claim 13 wherein the weight ratio of nickel to iron is from about 1:1 to about 100:1.

17. A process according to claim 13 wherein the weight ratio of nickel to iron is from about 6:4 to about 8:2.

18. A process according to claim 14 wherein the weight ratio of nickel to iron plus copper is from about 1:1 to about 100:1.

19. A process according to claim 18 wherein the weight ratio of iron to copper is from about 1:1 to about 100:1.

* * * * *